United States Patent [19]

Thompson et al.

[11] 4,359,292

[45] Nov. 16, 1982

[54] COSMETIC DISPENSER

[75] Inventors: Harold R. Thompson, Duxbury; Ernest H. Duval, Winthrop, both of Mass.

[73] Assignee: The Gillette Company, Boston, Mass.

[21] Appl. No.: 220,600

[22] Filed: Dec. 29, 1980

Related U.S. Application Data

[63] Continuation of Ser. No. 29,603, Apr. 13, 1979, abandoned.

[51] Int. Cl.[3] ..... B43K 7/10

[52] U.S. Cl. ..... 401/215; 401/213; 401/292; 401/216

[58] Field of Search ..... 401/27, 22, 292, 137, 401/208, 209, 212, 213, 215, 216, 219

[56] References Cited

U.S. PATENT DOCUMENTS

| | | | |
|---|---|---|---|
| 2,981,968 | 5/1961 | Schaich | 401/213 |
| 3,036,328 | 5/1962 | Schaich | 401/213 |
| 3,055,041 | 9/1962 | Schaich | 401/215 X |
| 3,085,554 | 4/1963 | Caplan | 401/208 |
| 3,235,900 | 2/1966 | Klassen | 401/215 X |
| 3,242,522 | 3/1966 | Jass et al. | 401/213 |
| 4,021,125 | 5/1977 | Berghahn et al. | 401/213 |
| 4,050,826 | 9/1977 | Berghahn et al. | 401/213 |
| 4,168,128 | 9/1979 | Fillmore et al. | 401/219 |

*Primary Examiner*—Edward M. Coven
*Attorney, Agent, or Firm*—Mandel E. Slater

[57] ABSTRACT

A cosmetic dispenser is disclosed which include a socket having a dispensing opening and three orthogonal axes, one axis extending through the socket and the other two lying substantially in the plane thereof. An applicator member is retained in the socket and has an upper portion extending exteriorly of the dispensing opening and a skirt portion substantially retained within the socket. The applicator is adapted for rotation about the three axes, but stop means limit rotation of the applicator member about the two axes in the plane of the socket. In this manner when rotation occurs about the axes of limited rotation, the dispenser is operable to feed cosmetic across the skirt portion to the upper portion of the applicator member for application to a surface to be treated with the cosmetic.

17 Claims, 10 Drawing Figures

COSMETIC DISPENSER

This application is a continuation of application Ser. No. 029,603, filed Apr. 13, 1979, abandoned.

BACKGROUND OF THE INVENTION

1. Field of the Invention

This invention relates to cosmetic dispensers, and is directed more particularly to such dispensers in which the cosmetic is dispensed by means of a rotating application member.

2. Description of the Prior Art

Cosmetic dispensers of the so-called "roll-on" type are well known in the art and have enjoyed wide commercial use, especially in the application to the skin of deodorants and antiperspirants. While numerous variations of such dispensers are known, they generally include a ground ball application member rotatably secured within a socket having a dispensing opening. The product is carried on the surface of the rotating ball to the dispensing opening for application, in the case of the above-mentioned cosmetic products, to the skin of the user. These dispensers are generally convenient to use and can apply the dispensed product accurately at the site where it is needed; with the trend away from aerosol dispensing, they are coming in for renewed interest.

However, known roll-on cosmetic dispensers utilizing a ball turning in a socket exhibit the undesirable tendency to entrap and pull on body hair, a problem which affects a substantial portion of male users of roll-on deodorants and anti-perspirants.

Another problem associated with known roll-on dispensers is the high manufacturing cost associated with the ground ball, a problem which is becoming more important with what appears to be a growing consumer preference for roll-on dispensers with a larger roller ball than heretofore has been in wide use. A ground ball provides the precision surface to fit the socket with the precise tolerances needed for accurate dispensing, and it also seems to grip the skin better for positive rotation in its socket. However, the manufacturing process for the ball involves (1) molding, (2) grinding to restore roundness and eliminate mold marks, and (3) sorting out the samples that fail to meet specified tolerances. Therefore, substantial savings could be realized if the ground ball could be eliminated and replaced with a simple molded part.

A further difficulty with known roll-on dispensers having a ground ball is that after a period of use, drying of the product tends to leave deposits interfering with rotation of the ball, with the result that the ball drags on the user's skin, the ground surface no longer by itself adequate to insure proper rotation.

SUMMARY OF THE INVENTION

Accordingly it is an object of the invention to provide a cosmetic dispenser of the roll-on type which will allow the realization of significant cost savings in comparison with known roll-on dispensers.

Another object of the invention is the provision of a cosmetic dispenser of the roll-on type which does not tend to entrap and pull on the hair of the user.

A further object of the invention is to provide a roll-on dispenser in which deposits resulting from drying of the product do not interfere with proper operation of the device.

A further and more general object of the invention is to provide a roll-on cosmetic dispenser which achieves the aforementioned objects and at the same time is perceived by the user to be convenient and comfortable in use.

With the above and other objects in view, a feature of the present invention is the provision of a cosmetic dispenser which includes a socket having a dispensing opening and three orthogonal axes, one axis extending through the socket and the other two axes lying substantially in the plane of the socket. An applicator member retained in the socket has an upper portion extending exteriorly of the dispensing opening and a skirt portion substantially retained within the socket, the applicator member being adapted for rotation about the three axes. Stop means limit rotation of the applicator member about the two axes in the plane of the socket, in such manner that when rotation occurs about the axes of limited rotation, the dispenser is operable to feed cosmetic across the skirt portion to the upper portion of the applicator member for application to a surface to be treated with the cosmetic.

The applicator member need only rotate a small amount, perhaps 5° to 20° in any direction from a neutral or central point, with the result that it need not be a perfect sphere, and in fact in certain embodiments of the invention only relatively small portions of the applicator member surface are substantially spherical. This is so because the limited rotation means that only limited portions of the surface will ever have to cooperate with mating portions of the socket. In part for this reason the applicator member can now be a simple molded part, since there is no longer a need to provide a high precision sphericity over much of its surface. It also follows from the limited rotation of the applicator member that hair pulling is substantially eliminated.

The means restraining rotation of the applicator member may include structure associated therewith or with the socket portion of the dispenser, or both. In certain preferred embodiments the applicator member is in the form of a molded shell, generally of an inverted cup shape, being generally spherical only where it must fit a mating socket surface, and is limited in rotation by interference between the edge of the shell (or lip of the cup) and fixed stops formed in the socket part. In other preferred embodiments, the applicator member includes depending structure interfering with support structure for the socket, whereby to limit rotation. The invention also contemplates adjustable dispensing rates made possible by providing an upper portion of the socket in the form of a threadedly connected retainer which is adjusted up or down to increase or decrease the tolerance between the applicator member and socket and therefore the rate of product delivery.

As will be appreciated from the foregoing discussion, it should be noted that for the purposes of the present invention, the applicator member is not generally a sphere, although it usually has at least a partial spherical surface, but represents a modification of the somewhat like-functioning ball element of prior art roll-on dispensers. Like the corresponding element in the prior art, the applicator member generally rotates or pivots about a substantially fixed point, but does not undergo translational motion to any substantial degree.

It will also be appreciated that as a further consequence of the limited rotation feature substantially the same portion of the applicator member surface is always exposed through the dispensing opening of the socket, with the result that this portion never has to function as a bearing or a sealing surface. This aspect of the invention allows the exposed surface of the applicator member to be textured or contoured as desired for improved spreadability of the product or varying the user feel or sensation. For example, the surface may be flat, convex, concave, textured like a golf ball, rippled, stippled, and so forth. When the applicator member is smooth-finished and substantially flat or slightly convex, on application of the dispenser to the user's skin, the forces are spread over a larger area as compared to a spherical surface, and a comfortable, smooth, even silky feeling is perceived. Furthermore, when the exposed surface of the applicator member is more or less flattened, applying that flattened surface to the user's skin provides forces positively rocking the applicator member and breaking any dried deposits in the mechanism that might otherwise interfere with its rotation; this is another reason why a ground surface is not needed to assist proper operation. Another consequence of the limited rotation is that it is possible to provide dispensing openings through the applicator member itself. A still further consequence is that the limited rotation by itself would tend to result in a lower product flow rate, since the applicator member may be rotating during only a part of the user's movement across the skin, with the result that better flow control is easier to achieve and, of particular importance, the dimensions and their tolerances between applicator member and socket can be enlarged, further obviating the need for a ground ball surface.

The above and other features of the invention, including various novel details of construction and combinations of parts, will now be more particularly described with reference to the accompanying drawing and pointed out in the claims. It will be understood that the particular devices embodying the invention are shown by illustration only and not as a limitation of the invention. The principles and features of this invention may be employed in various and numerous embodiments without departing from the scope of the invention.

BRIEF DESCRIPTION OF THE DRAWING

Reference is made to the accompanying drawing in which are shown illustrative embodiments of the invention from which its novel features and advantages will be apparent.

DESCRIPTION OF THE PREFERRED EMBODIMENTS

Figure 1:
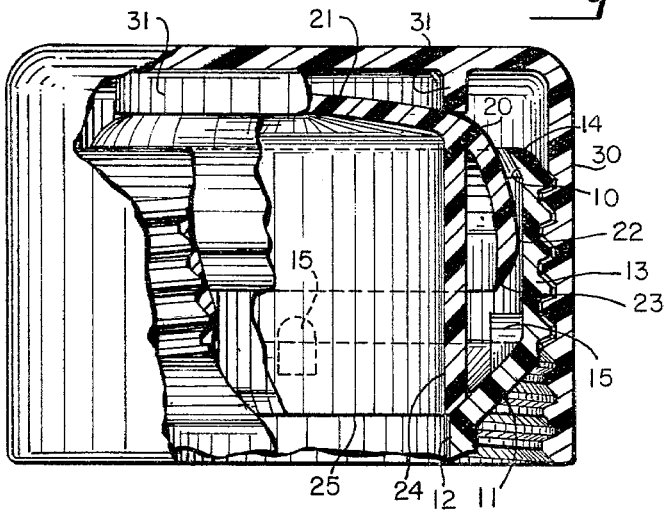
FIG. 1 is an elevational view, partially in section, showing a cosmetic dispenser illustrative of the invention.
Figure 2:
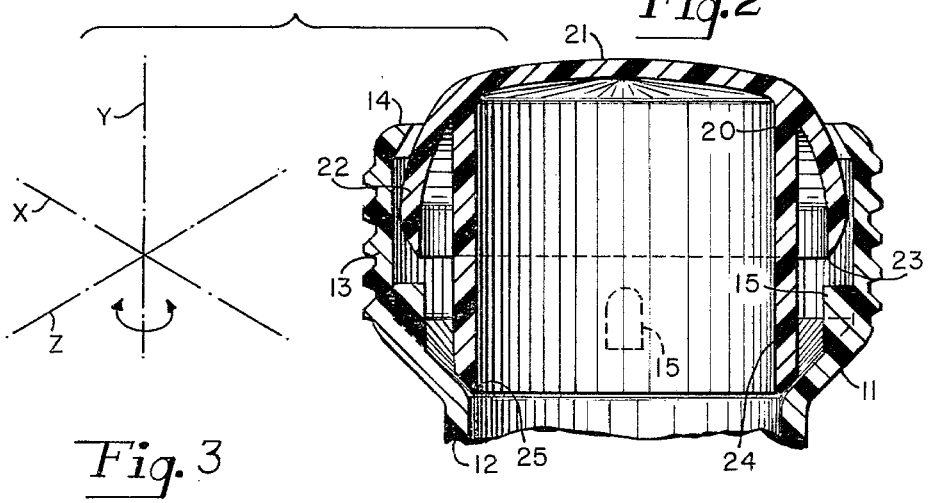
FIG. 2 is a sectional view of the device of FIG. 1, shown ready for dispensing.
Figure 3:
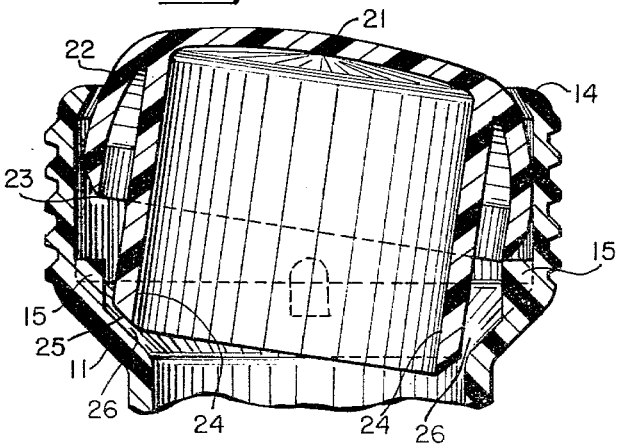
FIG. 3 is a view similar to FIG. 2, showing the applicator member in a position limiting its further rotation.

Referring to the drawing and in particular to FIGS. 1–3, it will be seen that the illustrative cosmetic dispenser includes socket 10 having a dispensing opening into which is fit applicator member 20, and cap 30. The socket is substantially circular in horizontal cross-section. A frusto-conical lower portion 11 of the socket 10 leads to neck 12 connecting to a product container (not shown). Above portion 11 a cylindrical section 13 of the socket is externally threaded for engagement with cap 30 and extends upwardly to terminate in an inwardly-directed retainer 14. Four stops 15 are spaced 90° apart on the inner surface of the socket at the inner section of frusto-conical portion 11 and cylindrical section 13. Ball 20 is an injection molded part snap fit into socket 10 and includes a smooth-surfaced somewhat convex upper portion 21 connected to a depending skirt 22 representing a section of generally spherical surface and terminating at lip 23. Depending cylindrical tube 24 extends from the intersection of upper portion 21 and skirt 22 to a lower end 25 resting on the frusto-conical portion 11 of socket 10. Cap 30 has internal threads mating with the external threads on socket 10 and in the upper section thereof includes internal ring 31.

When cap 30 is screwed down on socket 10, ring 31 applies pressure uniformly around the perimeter of upper portion 21 of applicator member 20 to force it straight downward in the socket to bring lower end 25 of tube 24 into sealing relationship on frusto-conical portion 11, establishing a tight seal when the cap is completely screwed down, as best shown in FIG. 1. This seal is no longer maintained with the cap removed (FIG. 2), and flow communication is established from the product container, into the socket between portion 11 and the lower end 25 of tube 24, then through the clearance between skirt 22 and cylindrical section 13 and retainer 14, and to the outside.

Certain aspects of the operation of the dispenser may best be understood with reference to the three orthogonal axes, X, Y, Z, represented in isometric view as part of FIG. 2, but applicable in like manner to other embodiments of the invention. As shown, the Y-axis represents an axis through the socket, while the X- and Z-axes lying substantially in what may be conveniently termed the plane of the socket, a plane orthogonal to the sectional view constituting FIG. 2 and, as previously indicated, also to the Y-axis. As will be seen in more detail hereinbelow, the applicator member of the invention may rotate about all three axes, but stop means limit rotation about the X- and Z-axes. Thus the applicator member is adapted to tilt back and forth about the X- and Z-axes within limits defined, in the example of FIGS. 1–3, by stops 15.

In operation the dispenser is up-ended sufficiently to bring the product to the socket area, where rotation of the applicator member through any angle of tilt assists product flow to the outside for distribution by the upper portion 21 of applicator member 20 on a surface to which the product is applied. As seen in FIG. 3, rotation of the applicator member on frusto-conical portion 11 as a bearing surface is limited by the interference of lip 23 with stops 15, but it will be appreciated that with a slight modification of construction, the rotational limit could instead be by interference of lower end 25 of tube 24 with the stops 15. It is also shown in FIG. 3 that rotation of the applicator member to its limiting position opens up the flow channel between the elements 11 and 25, as shown at 26, insuring sufficient delivery of product.

It will be apparent that in the device of FIGS. 1-3, stops 15 may be fewer or greater in number than the four shown, or they may be combined in the form of a continuous molded ring around the inner circumference of the socket.

Figure 4:
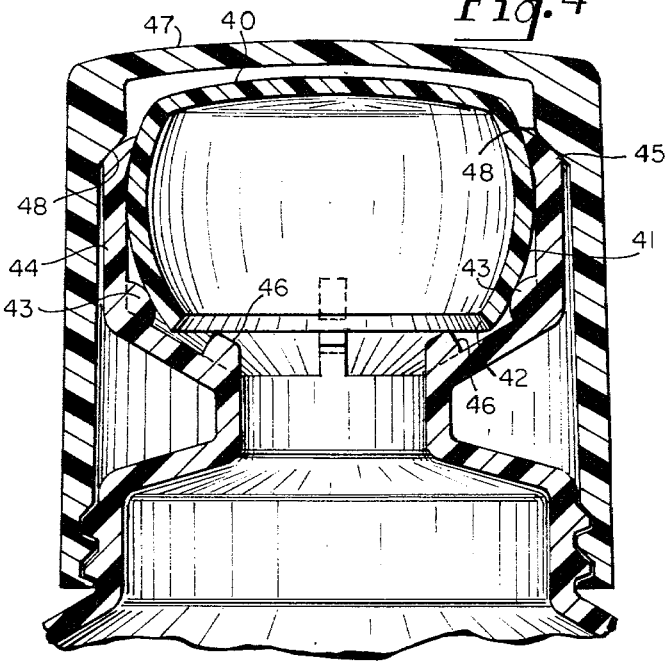
FIG. 4 is an elevational sectional view illustrative of a second embodiment of the invention.
Figure 5:
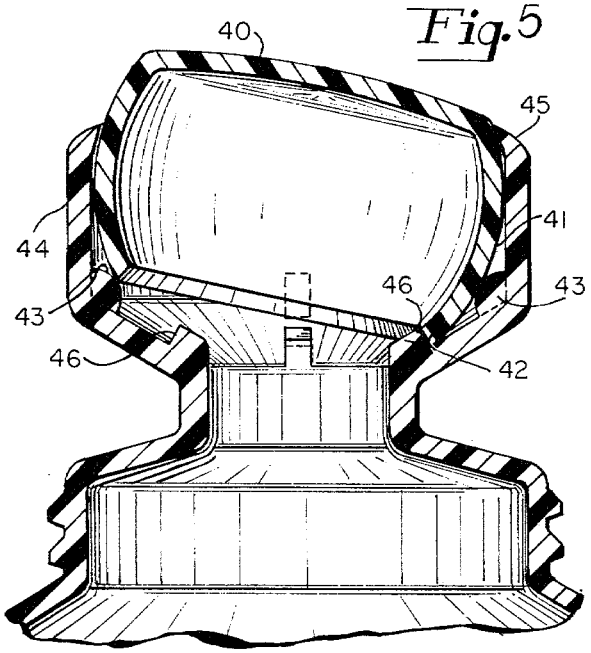
FIG. 5 is a view similar to FIG. 4, showing the applicator member in a position limiting its further rotation.

Referring now to FIGS. 4 and 5, the cosmetic dispenser shown therein includes an applicator member 40 shaped like an inverted cup, with skirt 41 of sufficient length to provide a bearing surface in cooperation with four bosses 43 equally spaced around the inside of socket 44. The skirt terminates at its lower end in lip 42. Retainer portion 45 of socket 44 holds the applicator member in the assembly, and four equally spaced stops 46 at the lower end of the socket limit rotation of the applicator member. A cap 47 includes a cam ring 48 bearing on the retainer portion 45 and compressing it inwardly to seal the system when it is not in use. With the cap removed, the applicator member is free to rotate as the dispenser is moved back and forth along a surface to which the cosmetic product is to be applied, the rotation limited now by interference between lip 42 and stops 46, as best shown in FIG. 5.

Figure 6:
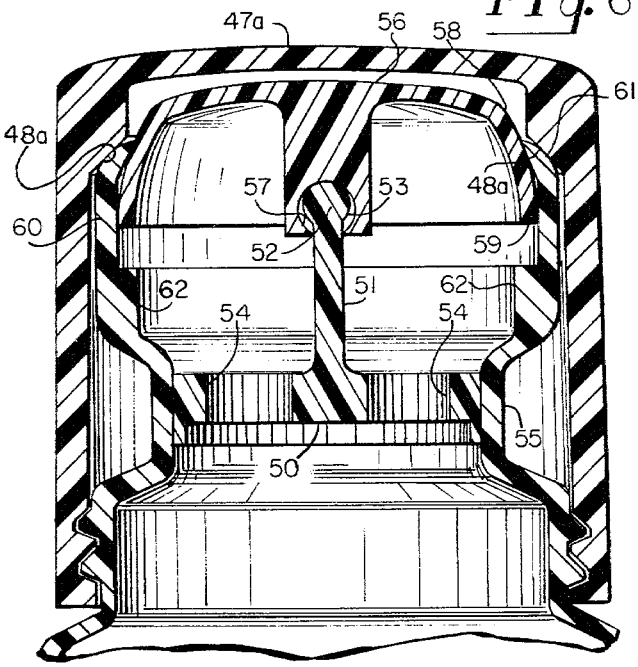
FIG. 6 is an elevational sectional view illustrative of a third embodiment of the invention.
Figure 7:
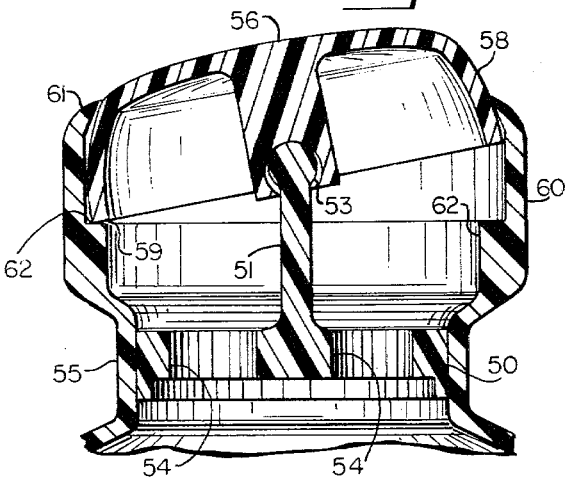
FIG. 7 is a view similar to FIG. 6, showing the applicator member in a position limiting its further rotation.

A further embodiment of the invention is shown in FIGS. 6 and 7, in which the applicator member rotates on a central pivot comprising a separate ball-and-socket joint. A post 51 supporting the ball portion 52 of the ball-and-socket joint 53 projects upwardly as part of a fitment 50 which includes ducts 54 for product flow and which is secured within the neck 55 of the dispenser by any suitable means. An applicator member 56 includes depending structure forming a socket portion 57 of ball-and-socket joint 53 plus a skirt 58 terminating in lip 59 and received within retainer portion 61 of socket 60. Interiorly of the socket are four equally-spaced stops 62. A cap 47*a* includes a cam ring 48*a* bearing on the retainer portion 61 and compressing it inwardly to seal the system when not in use. With the cap removed, rotation of the ball on ball joint 53 is limited by interference between lip 59 and stops 62, as best shown in FIG. 7.

Figure 8:
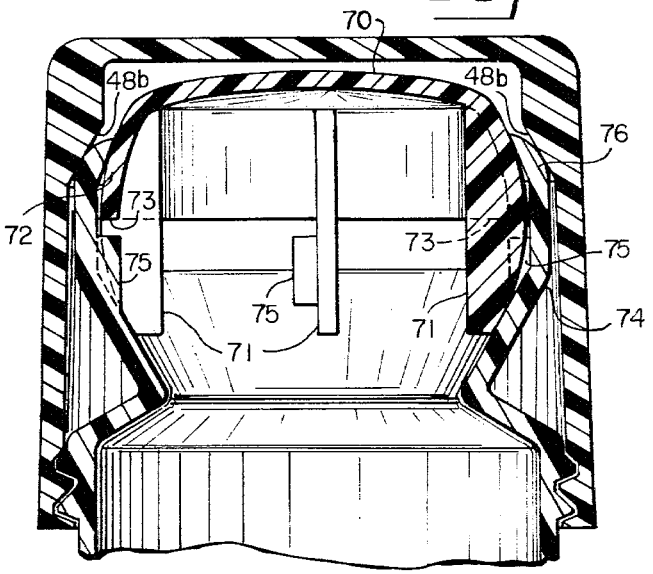
FIG. 8 is an elevational sectional view illustrative of a fourth embodiment of the invention.
Figure 9:
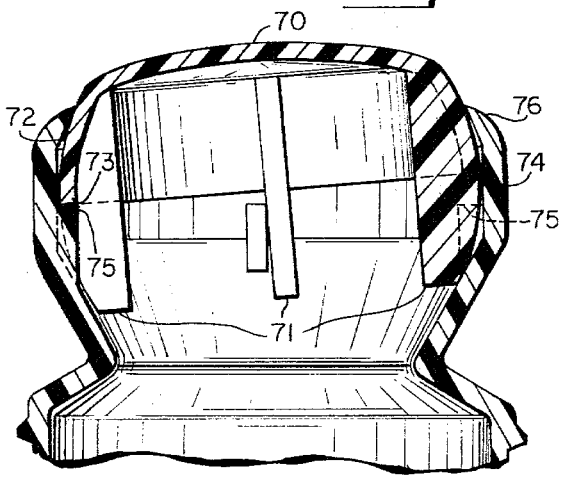
FIG. 9 is a view similar to FIG. 8, showing the applicator member in a position limiting its further rotation.

In the embodiment of FIGS. 8 and 9, the applicator member 70 rotates on four equally-spaced vertical ribs 71 molded interiorly of the ball, in cooperation with the inner surfaces of socket 74. In a manner previously described rotation is limited by interference between lip 73 of skirt 72 and four equally-spaced stops 75 formed in the socket 74, and sealing is by means of cam ring 48*b* compressing retainer portion 76 against the ball. In this embodiment, and in the manner clearly shown in FIGS. 8 and 9, ribs 71 and stops 75 may be so dimensioned as to limit rotation also about the axis through the socket, the Y-axes discussed above in connection with the description of FIG. 2.

Figure 10:
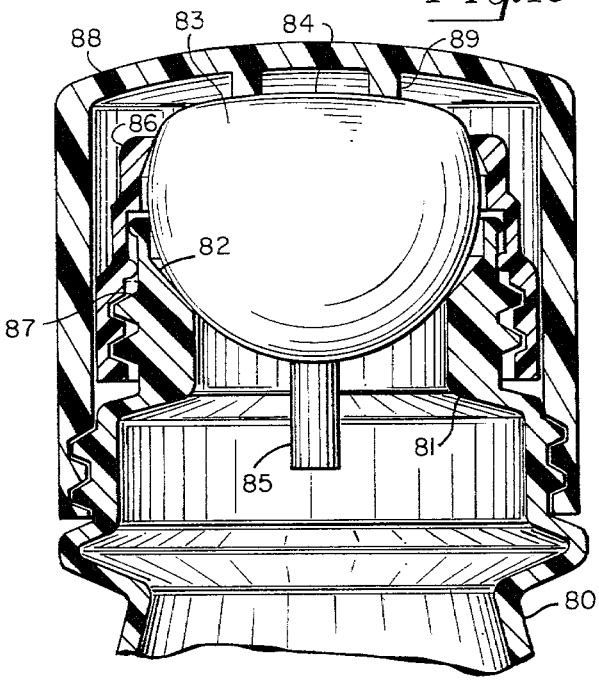
FIG. 10 is an elevational sectional view illustrative of yet a fifth embodiment of the invention.

In the embodiment shown in FIG. 10 the means restraining rotation of the applicator member include structure attached thereto interfering with the inside walls of the product container. In addition means are provided for adjusting the rate of product flow. The product container 80 narrows at neck portion 81 to form a socket 82 which receives applicator member 83. The applicator member has a smooth, flattened, slightly convex upper surface 84, and depending from its lower end is a short post 85, molded integrally therewith. The applicator member is held in the socket by a retainer 86, connected to the socket by screw threads 87. The system is sealed by a cap 88 with an internal ring 89 which, when the cap is in place, presses down on the upper surface 84 of applicator member 83 to center it and force it into sealing relationship with complementary surfaces of the socket 82. When the cap is removed, product can flow between applicator member and socket in the manner previously described, aided by rotation of the applicator member between limits determined when post 85 interferes with neck portion 81 of the container. By raising and lowering retainer 86, utilizing screw threads 87, the overall tolerances around the applicator member are varied, thereby controlling the flow rate.

While various aspects of the invention have been illustrated by the foregoing detailed embodiments, it will be understood that various substitutions of equivalents may be made without departing from the spirit and scope of the invention.

What is claimed is:

1. A cosmetic dispenser comprising a socket having a dispensing opening and three orthogonal axes, one axis extending through said socket and the other two of said axes lying substantially in the plane of said socket; an applicator member retained in said socket and having an upper portion extending exteriorly of said dispensing opening and a skirt portion substantially retained within said socket, said applicator member being adapted for rotation about said three axes; and stop means limiting the rotation of said applicator member about said two axes in the plane of said socket, in such manner that when rotation occurs about said axes of limited rotation, the dispenser is operable to feed cosmetic across said skirt portion to said upper portion of said applicator member for application to a surface to be treated with said cosmetic.

2. A cosmetic dispenser as defined in claim 1, in which said applicator member includes only a partial spherical surface.

3. A cosmetic dispenser as defined in claim 1, in which said upper portion is substantially flat.

4. A cosmetic dispenser as defined in claim 1, and further including a cap for sealing said dispenser.

5. A cosmetic dispenser as defined in claim 4, in which said cap includes means biasing said applicator member into sealing relationship with said socket.

6. A cosmetic dispenser as defined in claim 4, said cap including means compressing said socket into sealing relationship with said applicator member.

7. A cosmetic dispenser as defined in claim 1, and further including container structure connected to said socket, in which said stop means comprises a post depending from said applicator member, said post interfering with said container structure whereby to limit rotation of said applicator member.

8. A cosmetic dispenser as defined in claim 1, and further including means for adjusting a clearance between said applicator member and said socket.

9. A cosmetic dispenser as defined in claim 8, in which said adjusting means comprises applicator member retaining means threadedly connected to said socket.

10. A cosmetic dispenser as defined in claim 1, and further including bearing structure facilitating rotation of said applicator member within said socket.

11. A cosmetic dispenser as defined in claim 10, in which said bearing structure comprises tubular structure depending from said applicator member and terminating in a lower end, said lower end adapted to ride on a frusto-conical portion of said socket.

12. A cosmetic dispenser as defined in claim 10, in which said bearing structure comprises a boss in said socket supporting said skirt portion of said applicator member.

13. A cosmetic dispenser as defined in claim 10, in which said bearing structure comprises a rib formed interiorly of said applicator member and extending exteriorly thereof, said rib adapted to ride on an interior surface of said socket.

14. A cosmetic dispenser comprising a socket having a dispensing opening and three orthogonal axes, one axis extending through said socket and the other two of said axes lying substantially in the plane of said socket; an applicator member retained in said socket and having an upper portion extending exteriorly of said dispensing opening and a skirt portion substantially retained within said socket, said applicator member being adapted for rotation about said three axes; and stop means limiting the rotation of said applicator member about said two axes in the plane of said socket, said stop means comprising a fixed stop within said socket and structure on said applicator member interfering with said stop, whereby to limit rotation of said applicator member, in such manner that when rotation occurs about said axes of limited rotation, the dispenser is operable to feed cosmetic across said skirt portion to said upper portion of said applicator member for application to a surface to be treated with said cosmetic.

15. A cosmetic dispenser as defined in claim 14, in which said structure comprises said skirt portion.

16. A cosmetic dispenser as defined in claim 14, in which said structure comprises tubular structure depending from said applicator member.

17. A cosmetic dispenser comprising a socket having a dispensing opening and three orthogonal axes, one axis extending through said socket and the other two of said axes lying substantially in the plane of said socket; an applicator member retained in said socket and having an upper portion extending exteriorly of said dispensing opening and a skirt portion substantially retained within said socket, said applicator member being adapted for rotation about said three axes; stop means limiting the rotation of said applicator member about said two axes in the plane of said socket; and bearing structure facilitating rotation of said applicator member within said socket, said bearing structure comprising a ball-and-socket joint having a first connection to and interiorly of said applicator member and a second connection to said dispenser, in such manner that when rotation occurs about said axes of limited rotation, the dispenser is operable to feed cosmetic across said skirt portion to said upper portion of said applicator member for application to a surface to be treated with said cosmetic.

* * * * *